United States Patent [19]

Martin

[11] Patent Number: 4,555,666

[45] Date of Patent: Nov. 26, 1985

[54] ENERGY-STABLE ACCELERATOR WITH NEEDLE-LIKE SOURCE AND FOCUSED PARTICLE BEAM

[76] Inventor: Frederick W. Martin, Colebrook Rd., North Stratford, N.H. 03590

[21] Appl. No.: 379,736

[22] Filed: May 19, 1982

Related U.S. Application Data

[63] Continuation of Ser. No. 25,027, Mar. 29, 1979, abandoned.

[51] Int. Cl.[4] ..... H01J 23/00; H01J 23/34

[52] U.S. Cl. ..... 326/233; 328/228; 313/159; 313/161

[58] Field of Search ..... 328/227, 228, 229, 233; 315/5.41, 5.42; 313/237, 336, 359.1, 361.1, 259.1, 261.1

[56] References Cited

U.S. PATENT DOCUMENTS

| | | | |
|---|---|---|---|
| 3,376,449 | 4/1968 | Harrison | 313/361.1 |
| 3,476,972 | 11/1969 | Katagiri et al. | 313/237 |
| 3,638,127 | 1/1972 | Kerns | 328/233 |
| 3,691,377 | 9/1972 | Matsui et al. | 328/233 |
| 3,723,791 | 3/1973 | Stocklein | 313/237 |
| 3,749,963 | 7/1973 | Frederickson et al. | 328/228 |
| 3,881,125 | 4/1975 | Baker et al. | 313/237 |
| 3,906,280 | 9/1975 | Andelfinger et al. | 313/336 |
| 4,020,387 | 4/1977 | Coates et al. | 313/336 |
| 4,350,927 | 9/1982 | Maschke | 315/5.42 |

*Primary Examiner*—Saxfield Chatmon

[57] ABSTRACT

A high voltage particle accelerator and an energy analyzer fed back to the accelerator, in which the beam of extremely small diameter from a particle source of the field-emission or field-ionization type and the energy analyzer function to produce precisely defined high voltages; use of such an accelerator and focusing lenses to produce a microbeam with reduced chromatic aberration; and production of a microbeam by use of such an accelerator and focusing lenses of the achromatic quadrupole type, further compensated for aperture aberration.

11 Claims, 1 Drawing Figure

ENERGY-STABLE ACCELERATOR WITH NEEDLE-LIKE SOURCE AND FOCUSED PARTICLE BEAM

This is a continuation of application Ser. No. 25,027, filed Mar. 29, 1979, now abandoned.

BACKGROUND OF THE INVENTION

Many accelerators consist of a means of applying high voltage to a large metal box called a terminal, an ion source for generating ions which are to be accelerated, and an acceleration tube in which the ions traverse the high voltage and thereby gain energy. In order to obtain voltages in the megavolt range in a room of reasonable size, the terminal is confined inside a pressure tank which is filled with insulating gas at high pressure, the purpose of the gas being to prevent sparks across the short distance from terminal to tank. Also since the acceleration of ions would be impeded if they ran into gas molecules, the inside of the accelerator tube is evacuated.

Most accelerators use a plasma ion source consisting of a glass bottle inside which a gas discharge is maintained by power coupled into the discharge from the coil of a radiofrequency oscillator. Ions leaving the surface of the plasma in this discharge are accelerated and focused by a DC potential between the plasma and an exit canal, which is typically a small hole in an aluminum rod.

In the prior art, sources of the field ionization type have been installed in accelerators. Such a source typically consists of a very fine needle with a hemispheric point having a radius on the order of 500 Angstroms, maintained at a positive voltage of the order of 10 to 20 kilovolts in a gas at a pressure less than $10^{-4}$ millimeters of mercury. The gas near the tip is ionized by the extremely high electric fields at that point and accelerated along paths appearing to radiate from a small region near the center of the hemisphere. This property of emanation from an apparent source of size as small as 10 Angstroms result in extremely high brightnesses, as great as $10^8$ amperes per steradian per $cm^2$ of source size at 10–20 KV.

Field emission sources of electrons are also well known in the prior art of scanning electron microscopy. These consist of a tip of similar or identical geometry to that of a field ionization source, operated at negative potential and in high volume.

Prior art teaches how an accelerator beam may be directed through a magnetic or electrostatic energy analyzer, 54 and how a signal can be derived from a pair of slits 55 at the focus of an analyzer, the signal from one slit increasing and the signal from the other decreasing if the center of the beam approaches the first slit because of a deviation from the desired energy. This procedure has the advantage of eliminating a temperature-dependent, discharge-prone voltage-divider network for measuring the high voltage, and of substituting an analyzer which may be made thermally, mechanically and vibrationally stable and in which deflecting voltages or magnet currents may be controlled to 1 part in $10^6$. Stabilities have been achieved by means of this principle which are as great as 200 Volts in 4 megavolts in ion accelerators using radiofrequency sources and 10 volts in 1 megavolt in electron accelerators using thermionic filament electron sources. The limiting factor is the size of the accelerator beam at the analyzer focus. In the electron accelerator this size has been reduced to 40 microns in an analyzer with radius 0.5 meters. Assuming control of the center of the spot position to 2.5 microns, the momentum uncertainty in the analyzer is $0.5\times10^{-5}$ and the resulting energy uncertainty is 1 part in $10^5$. In ion accelerators having radiofrequency ion sources with an exit canal of 0.5 mm diameter, this spot size is typically a fraction of a millimeter and the accompanying energy uncertainty is 1 part in $10^3$ to $10^4$.

The width of the particle beam at the analyzer focus is fundamentally determined by the geometry of the analyzer and the emittance of the particle beam. The emittance of a particle beam is proportional to the area which it occupies in the phase space composed of its transverse position and momentum. According to Liouville's theorem of mechanics, this area does not change as the beam passes through a linear optical system. Thus when the beam from a given ion source arrives at an analyzer, where its maximum transverse momentum is defined by the instrument aperture and the distance of this aperture from the exit slits, there will be a minimum size smaller than which the beam cannot be focused without loss of current.

SUMMARY OF THE INVENTION

The present invention consists of an accelerator with a needle-type source.

The needle-type source and energy-analyzing system of the accelerator allow control of the high voltage to a high degree of accuracy. Since the angles of emergence of particles from such a source are not much larger than from other sources, while the effective size of the source is many orders of magnitude smaller, such a source functions to provide a particle beam which has an emittance which is many orders of magnitude smaller than the emittance of beams from other sources. The minimum possible size of the focus at the output of the energy analyzer will then be many orders of magnitude smaller. Although aberrations in the ion source, extraction and focusing structures, accelerator column, and energy analyzer will increase the beam size, such aberrations can in principle be reduced or compensated by elaborate enough design. Hence in a high-voltage accelerator using a needle-type source, aperture aberrations are the barrier to the achievement of stability, rather than the nature of the ion source.

For example, a field ion source having an effective source size of some 30 Angstroms operating into an aperture with an acceptance angle of about 40 milliradians can produce currents of hydrogen ions of 0.1 to 1.0 nanoamperes. In a system having an accelerating tube with an ion-optical magnification of 3.0 and an analyzing magnet with an ion-optical magnification of 1.0, the full current can in principle be delivered into a focus of 100 Angstoms dimension at the exit of the analyzer. In practice, aberrations in equipment suitable for magavolt energies will increase this dimension to a value as large as 1.0 microns. Since the radius of curvature of megavolt ions in a typical magnetic energy analyzer is about 1 meter, the precision which can be attained even with aberrations of this magnitude is about 1 part in $10^6$.

In addition to enabling the attainment of highly stable high voltages, the needle-type source and energy-analyzing system of the accelerator provide particle beams of precisely determined energy. Energy stability is of great usefulness in connection with focused beams of either ions or electrons, because of chromatic aberration in the focusing lenses. This is a particularly troublesome problem in very high-energy ion microscopy, where achromatic lenses depending on combined electric and magnetic fields become expensive, because the electric forces do not increase with the ion velocity and are not strong enough to focus the ions in short distances. For example two magnetic solenoid lenses with magnifications of 1/20, cascaded to produce a magnification of 1/400, would reduce a 10,000 Angstrom focus to about 25 Angstroms, if the lens aberrations were small enough. Chromatic aberration is given by the formula $$dx = C\alpha dE/E,$$

where dx is the amount of aberration, $\alpha$ is the convergence angle, and dE/E is the energy stability. In the thin lens approximation for a magnetic lens focusing rays from a very distant object, the chromatic aberration coefficient C is given by the relation $$C = f/2,$$

where f is the lens focal length. Thus for a lens with f=2 cm and a limiting aperture such that $\alpha = 1$ milliradian, energy stability $dE/E = 10^{-3}$ would result in a broadening of the focal spot by about 100 Angstroms, some 4 times its desired size of 25 Angstroms. The improved stability of an accelerator with a needle-type source eliminates this source of broadening.

However the improved accelerator will have a residual energy distribution in spite of its improved energy stability. If an accelerator or an energy analyzer is used which is not specifically designed for microscopy and which thus has large aperture aberration, or if the ion source is subject to undue vibration, the focus at the exit of the energy analyzer may be wider than 1 micron, and the resulting energy stability worse than 1 part in $10^6$. In addition, a limit to improvement obtainable in the accelerator is set by the inherent energy spread of the field ion source, which is a few electron volts, corresponding to $dE/E = 10^{-6}$ for a 1 MeV accelerator, and to a chromatic aberration is a few electron volts, corresponding to $dE/E = 3 \times 10^{-6}$ for a 1 MeV accelerator, and to a chromatic aberration dx=0.3 Angstroms. Achievement of chromatic aberration smaller than this limit posesses utility, because the fundamental limit to resolution set by competition between diffraction and aberration lies at about $\alpha = 0.1$ milliradian and beam size 0.1 Angstrom, even for lenses with large aperture aberrations.

Other lenses than solenoids are known in the prior art. The electrostatic lens analogous to the solenoid is the two-element or three-element cylindrically symmetrical lens. Electric and magnetic quadrupole lenses are also well known. Because a single quadrupole is not convergent in both of its principal sections, quadrupoles must be used in combinations such as doublets and triplets to obtain a beam focused in a point rather than a line. The prior are also teaches how electric and magnetic quadrupoles may be combined into a single achromatic quadrupole lens, both for electrons and ions, or into a single lens with negative chromatic aberration, which may used to compensate other lenses with positive chromatic aberration thereby making an achromatic lens system. To first order the focal length of an achromatic lens system is independent of particle energy.

Because of aperture aberrations, these lenses are not capable of producing perfect point focii even for ideally monoenergetic particle beams. The aperture aberration coefficients of quadrupoles are of third order in the convergence angles in the two principal sections. The magnitude of aberration dx' may be estimated by the formula $$dx' = C'\alpha^3,$$

where $\alpha = 1$ milliradian is a typical convergence angle and C' is the largest aberration coefficient, which for purposes of estimate may be taken as 100 times the focal length so that C'=3 meters approximately. In this case the aperture aberration would be about 30 Angstroms. Prior art teaches the use of a triplet of octopole lenses to cancel the three independent 3rd order aberration coefficients of quadrupoles in the magnetic, electrostatic, and achromatic cases, as well as how to combine octopole and quadrupole lenses in one achromatic structure.

Figure 1:
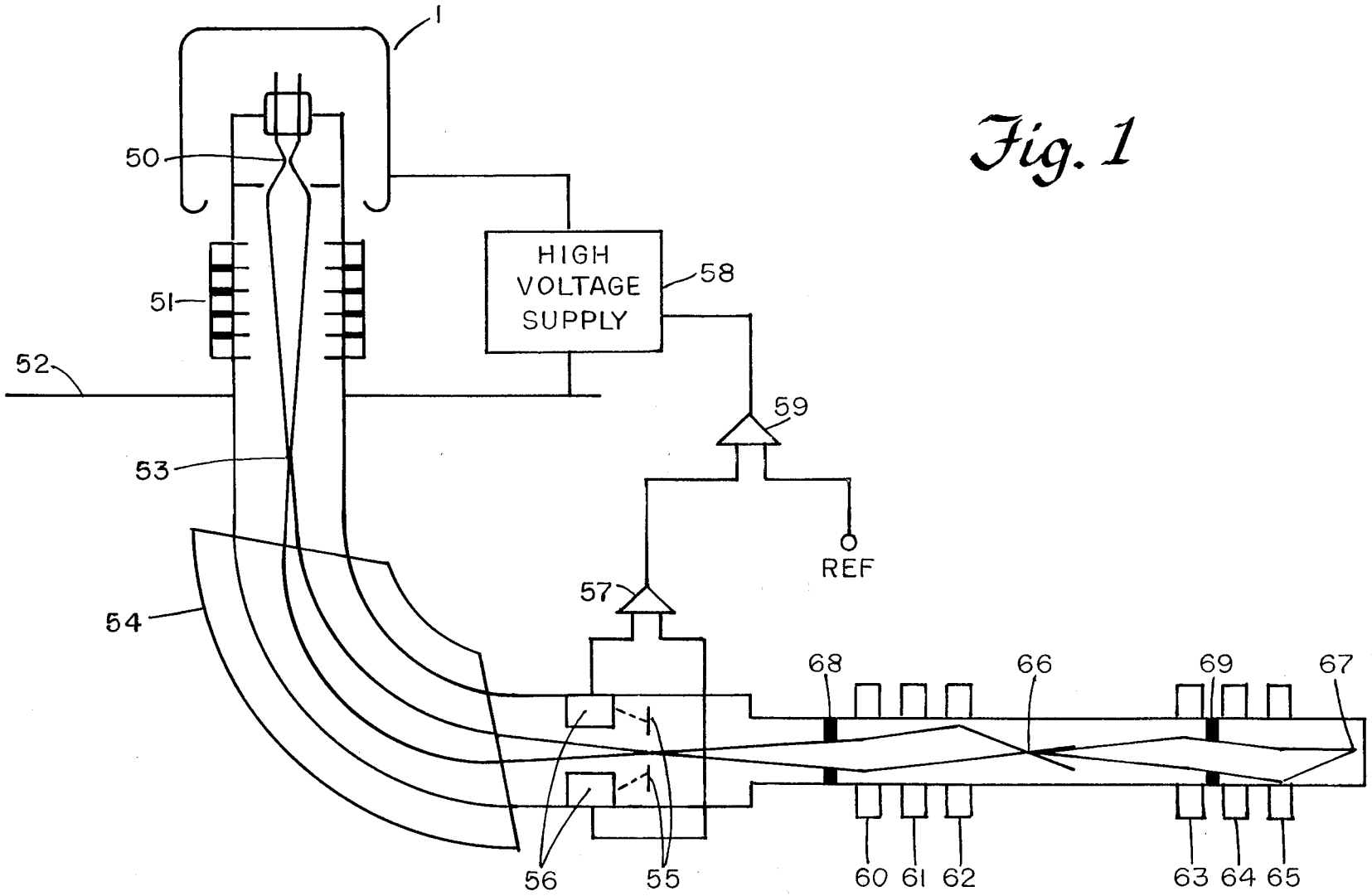
FIG. 1 shows an accelerator having a field ionization source, energy analyzer, and feed-back circuitry, which together with two stages of lenses produces a focused particle beam.

In the preferred embodiment shown in FIG. 1, the invention comprises a needle-type source 50, which may be either a field ionization source of ions or a field emission source of electrons, located in the high voltage terminal of an accelerator, and an energy-regulating system. The accelerator may or may not have a pressure tank and has an evacuated structure 51 extending between the terminal and a ground plane 52, such structure being of any length and configuration suitable for particle acceleration and focusing. The evacuated region extends through an energy analyzer 54 which may be of either the electrostatic or magnetic type and further into apparatus where the accelerated particles may be used. Between the ground plane 52 and the terminal 1 is connected a high voltage supply 58. This may be one of any well-known types, such as a Cockroft-Walton circuit, a moving charged belt device, an insulating core transformer, a multistage rectifier with high-frequency RF power capacitatively coupled to each stage, or a multistage rectifier with capacitatively resonated isolation transformers between each stage and RF power fed to the first stage. The proportional input of this supply is connected to a difference amplifier which is in turn connected to a second difference amplifier 57 and to a reference voltage. The accelerated particle beam 53, after passing through the energy analyzer 54, in part strikes and in part passes between a pair of slits 55 located at the exit focus of the energy analyzer. From the portion of the particle beam which strikes the slits a signal is derived to stabilize the voltage of the accelerator. This signal, which is fed into the two inputs of difference amplifier 57 from the two slits 55, may be any suitable signal, such as slit current, the number of particles scattered by the slits into detectors 56 per unit time, or the number per unit time of secondary electrons or electromagnetic quanta such as X-rays, UV, or visible photons detected by suitable detectors 56 and generated by the particle beam striking the slits.

When the ion beam passes exactly through the center of slits 55, the signals generated by them are equal and difference amplifier 57 produces no output. In this condition the reference voltage is adjusted so that the output of the second difference amplifier drives the high voltage supply 58 so as to provide an ion beam 53 of the proper energy to pass through analyzer 54 and arrive exactly at the center of slits 55. If the reference voltage is slightly adjusted, the ion beam will swing onto one of the slits 55, and an electrical signal will be generated by difference amplifier 57 which is of such a polarity that the second difference amplifier and the high voltage supply 58 act to generate a small change in the high voltage which returns the beam toward the center of the slits 55. In this condition the system will stabilize with a slight offset from exact beam centering, but because of large electronic gain present in detectors 56, difference amplifier 57, the second difference amplifier, and high voltage supply 58 the amount of offset is insignificant.

As recited in the Summary above, because the ions are generated by a needle-type source, the minimum possible size of the focus at the output of the energy analyzer 54 is many orders of magnitude smaller than in systems using other sources, aberrations being neglected. The band of energies which the system analyzes is therefore much smaller than in other systems, being limited by aberrations in the particle optical system, rather than by the nature of the ion source.

In FIG. 6 are also shown a plurality 60–65 of lenses which focus the particles into a beam of small cross section at locations 66 and 67. The angles of convergence at these locations are determined by apertures 68 and 69. The lenses are grouped into two stages of demagnification, each of which produces a focus and has an aperture stop. When these lenses are round or quadrupole lenses containing solely electric or solely magnetic fields, their combination with the accelerator enables reduction of chromatic aberration to a degree not possible by other means. When three additional lenses are octopoles, the combination of the stable accelerator and the plurality of lenses enables simultaneous reduction of chromatic aberration and compensation of aperture aberration. When the lenses contain electric and magnetic fields so combined as to render them achromatic, the combination enables correction of chromatic aberration associated with the residual energy spread of the accelerator.

Although the invention has been described in terms of positive ions, its principle applies to electrons, and to negative ions should they ever be generated with field ion sources, and although it has been described for an accelerator with a constant potential accelerating tube and a needle-type ion source, its principles apply to other accelerators, such as cyclic and linear multi-gap radiofrequency machines; and it is not intended to limit its description except by the following claims:

I claim:

1. An improved energy stabilized accelerator for producing beams of particles comprising a particle source, a means for accelerating particles, and an analyzer comprising a deflector which serves to measure the kinetic energy of accelerated particles and disperses them in position according to the difference of their energy from an undeviated central value, a pair of slits positioned at the focal point of said analyzer, a corresponding pair of means for producing electronic signals proportional to the current or pulse rate of particles which strike said slits, and electronic circuitry which produces an output signal indicating deviation of the beam energy from the undeviated, central value of energy specified by said analyzer, the output signal of which analyzer is subtracted electronically from a reference signal and fed back to the accelerating means in order to stabilize the particle energy at said central value, wherein the improvement comprises a field ion source for generating ions or a field emission source for generating electrons, and wherein said source, accelerating means, and analyzer function to provide particle beams of precisely determined energy.

2. An accelerator as described in claim 1 in which the particles are accelerated across a potential provided by a high-voltage direct-current power supply.

3. An accelerator comprising a direct-current, high-voltage power supply as described in claim 2 in which the particle beam emerging from said analyzer is not utilized, and the accelerator is utilized to supply a precisely determined high voltage.

4. An energy-stable accelerator as described in claim 1 the beam from which enters a plurality of lenses for focusing the particles into a beam of very small cross section, which beam suffers chromatic aberration only to the extent of any residual energy distribution of the accelerator about said precisely determined energy.

5. Means for formation of a microbeam as described in claim 4 in which the lenses include a plurality of octopole lenses for compensating aperture aberrations of the plurality of lenses.

6. An energy-stable accelerator and lenses as described in claims 4 or 5 in which electric and magnetic lenses are combined to form a plurality of achromatic lens systems, and in which chromatic aberration produced by the residual energy distribution of the accelerator is further compensated by the lenses.

7. An energy-stable accelerator as described in claim 1 the beam from which enters a plurality of achromatic quadrupole lenses for focusing the accelerated particles into a beam of very small cross section, in which chromatic aberration caused by the residual energy distribution of the stabilized accelerator is compensated by the achromatic lenses, so that said accelerator and said lenses function to form an achromatically focused microbeam.

8. Means for formation of an achromatically focused microbeam as described in claim 7, which further comprises a plurality of octopole lenses for the purpose of compensating the aperture aberrations of the system wholly or in part, simultaneously with compensation of chromatic aberration, in which means each octopole lens may be separate from or combined with the structure of an achromatic quadrupole lens.

9. An improved accelerator as described in claim 1 in which electronic slit signals are subtracted from each other by means of a difference amplifier to produce said electronic output signal, and in which a second difference amplifier is used to subtract said output signal from said reference signal.

10. An improved accelerator as described in claim 1 comprising an analyzer of the electrostatic or magnetic type, in which said central value is specified by the deflection voltage or magnet current of the analyzer.

11. The method of creating a beam of particles which simultaneously has extremely small diameter and extremely small deviation from a fixed energy comprising the steps of (a) providing an improved, energy-stabilized accelerator for producing beams of particles comprising a particle source, a means for accelerating particles, and an analyzer comprising a deflector which serves to measure the kinetic energy of accelerated particles and disperses them in position according to the difference of their energy from an undeviated central value, a pair of slits positioned at the focal point of said analyzer, a corresponding pair of means for producing electronic signals proportional to the current or pulse rate of particles which strike said slits, and electronic circuitry which produces an output signal indicating deviation of the beam energy from the undeviated, central value of energy specified by said analyzer, the output signal of which analyzer is subtracted electronically from a reference signal and fed back to the accelerating means in order to stabilize the particle energy at said central value, wherein the improvement comprises a field ion source for generating ions or a field emission source for generating electrons, and wherein said source, accelerating means, and analyzer function to provide particle beams of precisely determined energy, and (b) using the particle beam emergent from said improved accelerator.

* * * * *